US005424610A

United States Patent [19]

Pelton et al.

[11] Patent Number: 5,424,610

[45] Date of Patent: Jun. 13, 1995

[54] COMPACT FLUORESCENT OUTBOARD BALLAST

[75] Inventors: Bruce A. Pelton, El Sobrante; Louis Temesvary, Sunnyvale, both of Calif.

[73] Assignee: Lumatech Corporation, Emeryville, Calif.

[21] Appl. No.: 25,029

[22] Filed: Mar. 2, 1993

[51] Int. Cl.[6] ..... H01J 7/42; H01J 7/44; H05B 41/36; H05B 41/40

[52] U.S. Cl. ..... 315/58; 315/51; 362/411; 362/417

[58] Field of Search ..... 315/51, 52, 53, 54, 315/56, 57, 58, 71; 362/260, 388, 411, 417

[56] References Cited

U.S. PATENT DOCUMENTS

D. 279,031 5/1985 Suzuki .
4,178,535 12/1979 Miller ..... 315/53
4,414,489 11/1983 Young ..... 315/56 X
4,495,443 1/1985 Cummings ..... 315/56 X
4,503,360 3/1985 Bedel ..... 315/56 X
4,645,283 2/1987 MacDonald et al. ..... 315/56 X
5,065,292 11/1991 Aubrey .
5,164,635 11/1991 De Jong et al. .

*Primary Examiner*—David Mis
*Attorney, Agent, or Firm*—Haverstock, Medlen & Carroll

[57] ABSTRACT

An outboard ballast which allows a compact fluorescent light bulb and its associated ballast to be positioned within a standard table lamp having a standard-size harp. The ballast is divided into separate sections so that the sections and their housing can extend into an area beyond the harp and below the socket of the lamp fixture. A three-way switch circuit is provided to be adaptable with common table lamp fixtures. The configuration of the present invention provides security features.

10 Claims, 3 Drawing Sheets

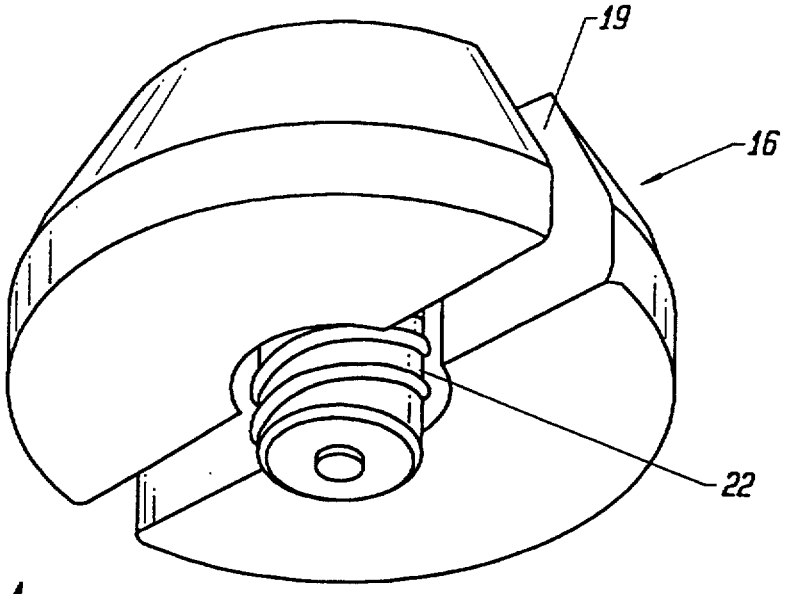
FIG. 4
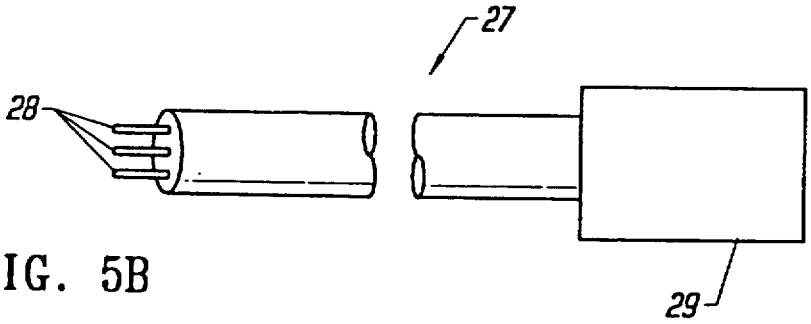
FIG. 5B
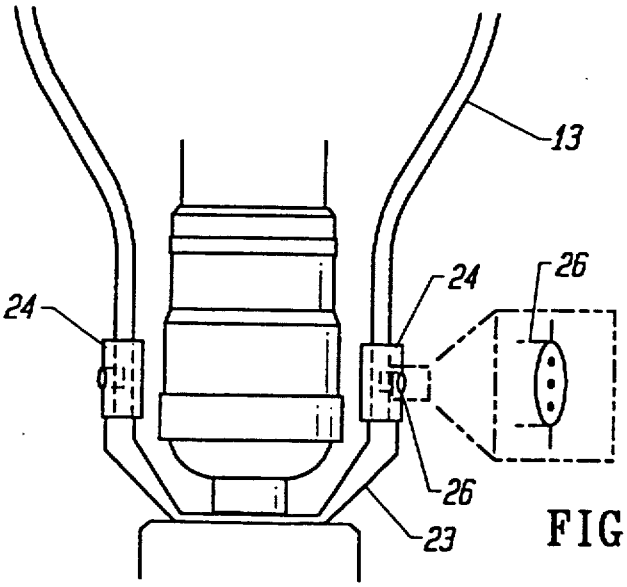
FIG. 5A
FIG. 5C

COMPACT FLUORESCENT OUTBOARD BALLAST

FIELD OF THE INVENTION

This invention relates to compact fluorescent light bulb fixtures. More specifically, it relates to a ballast and its housing which supports a compact fluorescent light bulb so that the combination fits into a standard table lamp fixture and within a standard-size harp.

BACKGROUND OF THE INVENTION

The well known energy saving value of compact fluorescent light bulbs often offsets their high initial price. Usage of compact fluorescent light bulbs is most attractive when their installation requires little or no lighting fixture retrofitting costs. While the frequency of their use has been increasing in many different lighting applications, the compact fluorescent light bulb's shape in combination with the size of ballasts continues to inhibit their usage in common table lamp fixtures.

Compact fluorescent light bulbs are long by necessity, and the ballasts are large and bulky due to their electrical and magnetic requirements. Traditionally, the ballast is positioned directly below the light bulb, making the combination of the two units too tall to fit into a standard table lamp configuration. Therefore, in order to install the light bulb and ballast combination in an average table lamp so that they will fit into the fixture, the standard-size harp typically used in a table lamp must be replaced with an extended harp. However, because most lamp shades are proportioned to fit over a standard-size harp, they are too short for an extended harp. Accordingly, when replacing the harp, the lamp shade must also be replaced. Therefore, the cost of using a compact fluorescent light bulb in a common table lamp becomes prohibitive.

SUMMARY OF THE INVENTION

The ballast configuration of the present invention allows a compact fluorescent light bulb in combination with the ballast to be positioned in a common table lamp fixture and within the confines of a standard-size harp. The electrical and/or magnetic components of the ballast are separated into two discreet ballast portions and therefore can be housed in a manner which avoids position interference with the standard-size harp's position. As indicated above, in a conventional ballast configuration, the ballast is directly below the light bulb. In the present invention, the ballast wraps around the socket and therefore the light bulb and the lamp fixture socket are essentially adjacent to one another. Hence, the light bulb sits much lower in the fixture than in the conventional compact fluorescent configurations, fitting well within the height constraints of a standard-size harp. The present invention described below further provides security mechanisms which avoid removal or theft of the light bulb and ballast from the table lamp. The ballast of the present invention is also usable with a three-way lighting system.

BRIEF DESCRIPTION OF THE DRAWINGS

FIG. 4 shows the bottom portion of the ballast shown in FIGS. 1–3;

FIGS. 5A, 5B and 5C depict a device and associated tool for locking the harp onto the lamp fixture in accordance with the present invention.

DETAILED DESCRIPTION OF THE INVENTION

Figure 1:
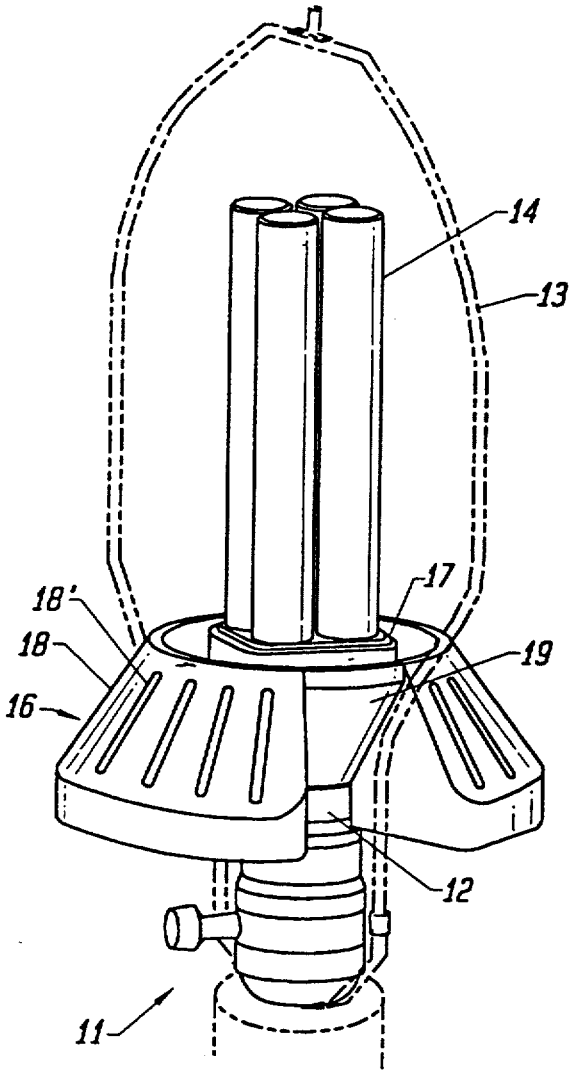
FIG. 1 shows a compact fluorescent light bulb supported by one embodiment of the ballast of the present invention, the combination of which being installed in a standard table lamp configuration.
Figure 2:
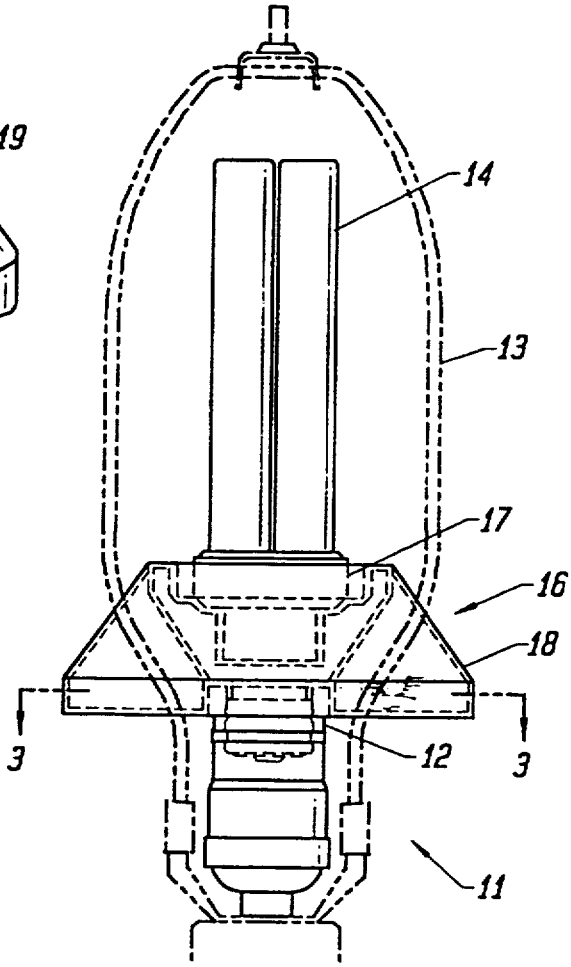
FIG. 2 is a view along cross-section 2 depicted in FIG. 1.

A table lamp fixture 11 as shown in FIGS. 1 and 2 includes a socket 12 for connecting a light bulb to the fixture and a standard-size harp 13 for holding a lamp shade (not shown) over the lighting fixture. Installed within fixture 11 is a compact fluorescent light bulb 14 and ballast 16 of the present invention. The light bulb 14 is positioned in the socket 12 so that they are linearly aligned and essentially longitudinally coaxial.

Figure 3:
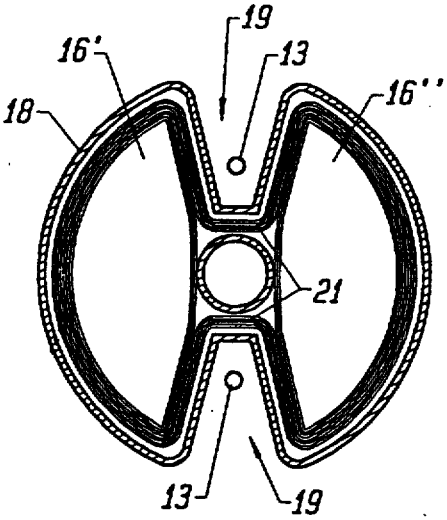
FIG. 3 is a view along cross-section 3 depicted in FIG. 2.

As shown in FIGS. 1–4, the ballast 16 is divided into two different portions. FIG. 3 best illustrates the individual and separate electrically operable sections 16' and 16'' of ballast 16. While the embodiment described herein includes two different ballast sections, the present invention may include other configurations, for example, more than two sections. By dividing the ballast into sections, the ballast 16 can be positioned substantially outside of the combined longitudinal axis of the light bulb 13 and light socket 12. Accordingly, the present invention allows the ballast to be positioned at a location different than directly below the light bulb, for example, on opposite sides of the light bulb and socket. Thus, the height of the combination of light bulb and ballast is short enough to fit below a standard-size harp 13.

As shown in FIGS. 1 and 2, the division of the ballast into sections, and their position which is substantially outside the axis of the light bulb 14 and the socket 12 allows the ballast 16 and its housing 18 to extend into an area beyond harp 13, particularly since the housing 18 includes slots 19 so that the harp 13 can pass therethrough. While slotted configuration shown in FIGS. 1–4 provides spaces for the harp 13 to pass therethrough, the extension of the ballast 16 and its housing 18 beyond the harp can also be effected by passing the harp 13 through any type of space such as holes (not shown) in the housing or other similar configurations. Accordingly, the ballast 16 and the light bulb 14 can be installed within the confines of a standard-size harp 13.

The electrical and/or magnetic ballast components of ballast portions 16' and 16'' include those traditionally used in compact fluorescent lighting. The housing 18 for housing such components, in accordance with the present invention, provides ventilation for the ballast components through vents 18' which allow ambient air to circulate within the housing and cool the components. Therefore, the ballast sections of the present invention are kept cool by the ventilation provided and by their distance from the heat generated by an illuminated light bulb 14.

While the ballast sections 16' and 16'' components are not shown in the drawings, they can be of the electronic type, the magnetic type or a hybrid type including both electrical and magnetic components. The means for coupling 21 the discreet portions 16 and 16'' is within the knowledge of one skilled in the art and is generally depicted in FIG. 3.

The embodiment of the present invention depicted in FIGS. 1–4 shows the curved housing 18 for ballast portions 16' and 16" symmetrically arranged with respect to the longitudinal axis of the light bulb 14 and socket 12. The installation of the ballast into the fixture is provided by a conventional screw-in member 22. Turning to FIG. 4, ballast 16 is shown with its screw-in member 22 protruding from the bottom side of the ballast. The screw-in member 22 mates with socket 12, thus providing the electrical connection to power the light bulb 14. FIG. 4 also illustrates that the upper portion of the screw-in member is positioned between the two symmetrically configured ballast halves, and therefore, when installed, the housing 18 is at least partially laterally aligned with the socket 12. Accordingly, the ballast portions wrap around the socket and therefore the light bulb screw-in member and the lamp fixture socket are positioned very close to one another, separated only by their respective electrical connection members. Hence, the light bulb sits much lower in the fixture than in the conventional compact fluorescent configurations, fitting well within the height constraints of a standard-size harp.

The symmetrically configured ballast housing inhibits removal of the combination of light bulb and ballast when the harp 13 is positioned so that it passes through the slots 19. In accordance with the present invention, because the ballast 16 and its housing 18 to extend into an area beyond harp 13, the harp must be removed in order to install the ballast into a fixture. If the harp 13 were not removed prior to installation, the ballast housing would collide with the harp while rotating within the socket, and installation could not be effected. Likewise, in order to unscrew and remove the ballast, the harp must be removed. The security advantage available due to the configuration of the present invention is particularly attractive in view of the high cost of the fluorescent components.

An added security advantage is provided by locking the harp to the lighting fixture so that it, and therefore the ballast and light bulb cannot be removed. Turning to FIG. 5A, the harp is attached to the table lamp fixture 23 by attachment members 24. The security device includes screw 26 which is embedded or passes through harp 13 to engage the harp firmly to the table lamp fixture. Preferably the screw's 26 head is flush against the surface of the attachment member 24. Furthermore, it also preferable that the head of the screw 26 has a pattern for removal which is not readily engageable. Such a pattern would include, for example, three holes or an inverted phillips head. Three holes are shown in the expanded view of screw 26. A tool 27 to engage the three holes is shown in FIG. 5B. The tool include three pins 28 to engage the holes and thus rotate the screw 26 for insertion into or removal from an attachment member 24. Added security for the ballast configuration of the present invention is thus provided.

Figure 6:
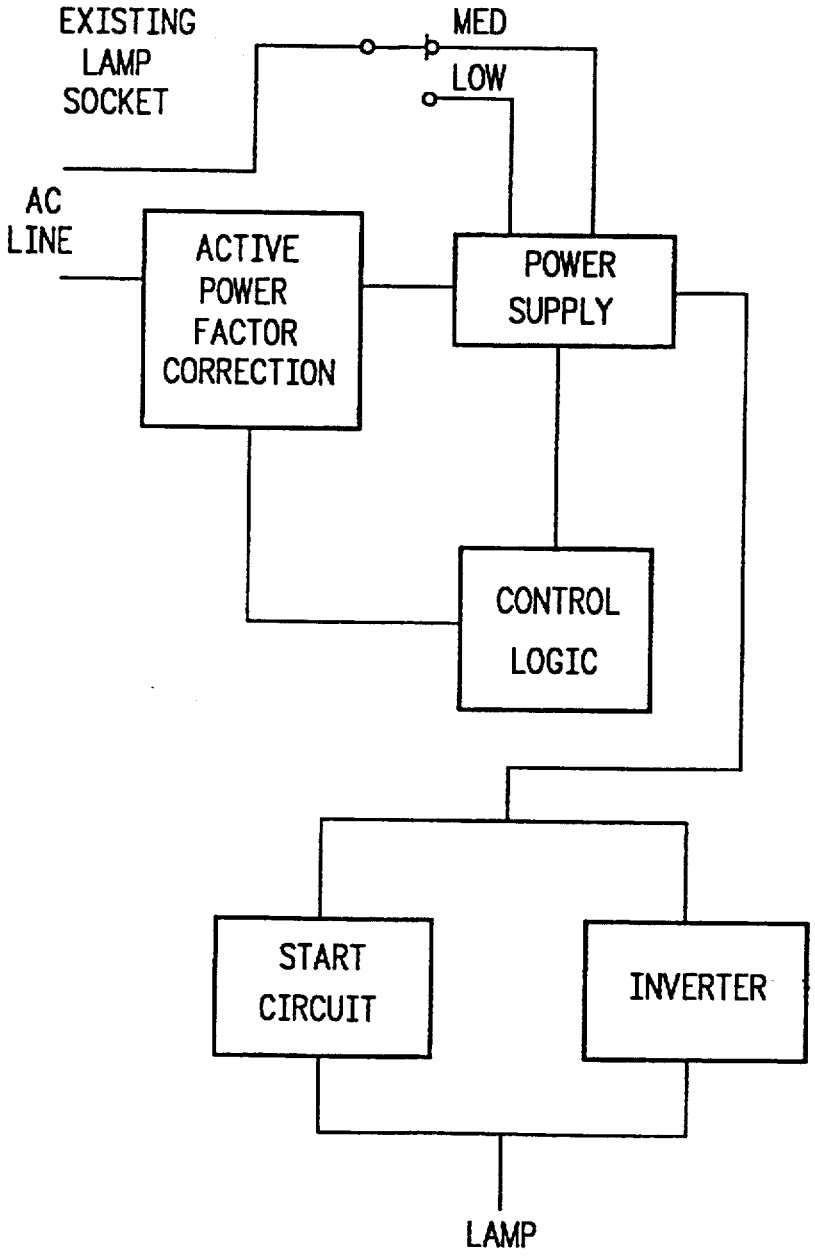
FIG. 6 is a block diagram of the three-way switch configuration of the ballast of the present invention.

Many table lamps fixtures include three-way lighting switches. The ballast configuration of the present invention includes electronics for illuminating the compact fluorescent light bulb 14 to three different intensities. FIG. 6 shows a block diagram for activation of discreet circuits combined to provide three different current flows to the light bulb, thus utilizing a three-way switch of a table lamp. Two lines to the AC and a ground (not shown) are provided at the EXISTING LAMP SOCKET. The ACTIVE POWER FACTOR CORRECTION is a magnetic coil transformer, electronic or hybrid ballast. The START CIRCUIT causes the cathodes to glow before the INVERTER sends a high voltage pulse across them and then the START CIRCUIT causes the cathodes to cease glowing. To illuminate the light bulb at its lowest level, the POWER SUPPLY includes the LOW current level through a first discreet circuit. To illuminate the light bulb at a medium level, the LOGIC CONTROL switches the POWER SUPPLY to provide the MED current level through a second discreet circuit. To illuminate the light bulb at a high level, the LOGIC CONTROL switches the POWER SUPPLY to provide current through both the first and second discreet circuits. Thus, the present invention is adaptable to any type of table lamp configuration.

We claim:

1. A ballast device for controlling the current flow from a current source to a compact fluorescent light bulb, comprising:

two discreet, electrically operable ballast portions;

means for coupling said two discreet, electrically operable ballast portions so that together they control the current flow to a compact fluorescent light bulb;

a first electrical circuit providing a first current flow to said compact fluorescent light bulb;

a second electrical circuit providing a second current flow to said compact fluorescent light bulb, wherein said second current flow is of a different magnitude of said first current flows;

a third electrical circuit which additively couples said first and said second electrical circuits and thereby providing a third current flow to said compact fluorescent light bulb; and wherein said ballast device is positionable within a table lamp fixture which includes a harp for a holding a lamp shade, said device further comprising a housing for housing said two discreet electrically operable ballast portions, wherein said housing includes a first radial wall portion and a second radial wall portion, together configured coaxially and with holes positioned to allow said harp to pass therethrough.

2. A device as recited in claim 1, wherein said table lamp fixture which includes a harp for holding a lamp shade comprises:

attachment members for attaching said harp to said table lamp fixture;

locking means for preventing tampering by locking said attachment members so that said harp may be substantially securely attached to said table lamp fixture.

3. An apparatus for positioning a compact fluorescent light bulb having a first axis within a lamp fixture which includes a socket having a second axis and a harp, said apparatus comprising:

a ballast having separate ballast sections;

positioning means for disposing said first axis of said compact fluorescent light bulb and said second axis of said lamp fixture socket so that they are substantially coaxial; and housing means for housing said separate ballast sections which includes a first radial wall portion and a second curved radial wall portion, together configured coaxially and with spaces positioned to allow said harp to pass therethrough.

4. An apparatus for positioning a compact fluorescent light bulb within a lamp fixture having a harp which includes a socket, said apparatus comprising:

a ballast having separate ballast sections;

a housing for housing said separate ballast sections and for positioning said light bulb in linear alignment with said socket, wherein said housing positions said separate ballasts so that together they wrap around said socket; and wherein said housing includes a first radial wall portion and a second curved radial wall portion, together configured coaxially and with spaces positioned to allow said harp to pass therethrough.

5. An apparatus for positioning a compact fluorescent light bulb within a table lamp having a socket wherein said table lamp fixture includes a harp for holding a lamp shade, said apparatus comprising:

electrical components for providing, among other functions, an electrical connection between a compact fluorescent light bulb and said table lamp socket; and a housing for said electrical components, wherein said housing includes a first radial wall portion and a second curved radial wall portion, together configured coaxially and with spaces positioned to allow said harp to pass therethrough.

6. An apparatus as recited in claim 5 wherein said electrical components further includes a ballast having individual and separate ballast portions electrically coupled together to function as a single ballast.

7. An arrangement as recited in claim 6 wherein said compact fluorescent light bulb and said table lamp socket are positionable in linearly aligned manner and said housing means further includes means for housing said individual and separate ballast portions on opposite sides of said linearly aligned compact fluorescent light bulb and table lamp socket.

8. A table lamp fixture which includes a harp for holding a lamp shade, comprising:

attachment members for attaching said harp to said table lamp fixture;

locking means for preventing tampering by locking said attachment members so that said harp may be substantially securely attached to said table lamp fixture.

9. A method for positioning a compact fluorescent light bulb within a lamp fixture which includes a socket, said method comprising the steps of:

providing a ballast having separate ballast sections; and providing a housing for housing said separate ballast sections and for positing said light bulb in linear alignment with said socket, wherein said housing includes a first radial wall portion and a second curved radial wall portion, together configured coaxially and with spaces positioned to allow said harp to pass therethrough.

10. A method for locking a harp to a table lamp fixture comprising the steps of:

providing attachment means for attaching said harp to said table lamp fixture;

providing locking means for preventing tampering by locking said attachment members so that said harp may be substantially securely attached to said table lamp fixture.

* * * * *

UNITED STATES PATENT AND TRADEMARK OFFICE

CERTIFICATE OF CORRECTION

PATENT NO. : 5,424,610

DATED : June 13, 1995

INVENTOR(S) : BRUCE A. PELTON *ET AL.*

It is certified that error appears in the above-identified patent and that said Letters Patent is hereby corrected as shown below:

In column 4, line 44, please delete "holes" and replace with --spaces--.

In column 4, line 43, before "radial" insert --curved--.

Signed and Sealed this

Twenty-eighth Day of November 1995

*Attest:*

Bruce Lehman

BRUCE LEHMAN

*Attesting Officer*

*Commissioner of Patents and Trademarks*